US005250016A

United States Patent [19]

Higgins

[11] Patent Number: 5,250,016

[45] Date of Patent: Oct. 5, 1993

[54] BASEBALL THROWING DEVICE FOR MUSCLE DEVELOPMENT, REHABILITATION AND TRAINING

[76] Inventor: David W. Higgins, 931 Prichard La., West Chester, Pa. 19382

[21] Appl. No.: 921,580

[22] Filed: Jul. 30, 1992

[51] Int. Cl.[5] ..... A63B 21/02

[52] U.S. Cl. ..... 482/121; 482/124; 482/51

[58] Field of Search ..... 273/58 C, 26 E; 482/130, 904, 129, 40, 131, 121-126, 91, 99, 49, 44

[56] References Cited

U.S. PATENT DOCUMENTS

| | | | |
|---|---|---|---|
| 169,419 | 11/1875 | Clark | 273/58 C |
| 688,449 | 12/1901 | Bell | 482/128 |
| 2,467,943 | 4/1949 | Mikell, Jr. | 482/124 |
| 3,006,647 | 10/1961 | Haskett | 273/26 E |
| 3,152,803 | 10/1964 | Sain | 273/26 R |
| 4,127,268 | 11/1978 | Lindgren | 273/58 C |
| 4,350,338 | 9/1982 | May | 273/58 C |
| 4,460,172 | 7/1984 | Hogan | 273/26 E X |

FOREIGN PATENT DOCUMENTS

| | | | |
|---|---|---|---|
| 6802124 | 8/1968 | Netherlands | 482/129 |

*Primary Examiner*—Richard J. Apley
*Assistant Examiner*—Jerome Donnelly

[57] ABSTRACT

The baseball throwing device is used for training arm muscles associated with throwing by simulating the throwing motion; is used for developing the arm muscles associated with throwing by doing strengthening exercises; and is used for rehabilitating the muscles associated with throwing by doing rehabilitation exercises.

The apparatus includes an elastic band or bands, depending on the tension desired, which are attached at one end to a hand frame with a ball included, and the other end of the elastic band/s is attached to a harness. To use, the harness is attached to any stationary object that a canvas harness can be wrapped around, such as a tree or post. Then grab the baseball hand frame and walk away from the harness therefore stretching the elastic bands to a comfortable tension. Then begin workout by simulating the throwing motion or by doing strengthening or rehabilitating exercises.

6 Claims, 3 Drawing Sheets

BASEBALL THROWING DEVICE FOR MUSCLE DEVELOPMENT, REHABILITATION AND TRAINING

BACKGROUND OF THE INVENTION

1. Field of the Invention

This present invention relates in general to baseball. More specifically, this invention relates to a training device used in developing or rehabilitating the muscles associated with throwing.

2. Prior Art

Previous invention, U.S. Pat. No. 4,846,471 issued on Jul. 11, 1989 to Albert M. Haysoom, was used in training and warm-ups, consisting of a ball with a circle of elastic cord through the ball. To set up, the end portion of the loop is inserted through and around the bar, following which the baseball is inserted through such loop end portion and pulled to create a hitch. The use of this apparatus is to simulate pitching movements for the youth. Limitations of the prior art are as follows:

1. By having the elastic tubing through the ball, the hand of the pitcher on the baseball is pinched by the tubing and is constricted from movement.
2. The elastic tubing cannot be replaced when wear or damage occurs, since the invention's cord is undetachable once it's threaded through the baseball.
3. Because the tubing is used for a harness, the elastic band is more apt for damage.
4. The previous invention does not allow for additional bands to be attached.

SUMMARY

This invention has been designed so that it may be used to strengthen or rehabilitate all the muscles associated with throwing. This invention is versatile because it can be used to simulate pitching/throwing along with performing wrist exercises, arm exercises, rotator cuff exercises, shoulder exercises, tricep exercises and more. (note: add additional bands for more intensity)

This invention can be used by the little leaguer up through the professional athlete, because the intensity of the workout can be increased by elongating the elastic band and by adding additional elastic bands. For instance, one elastic band may be enough for an endurance workout, but for advanced training, a second elastic band can be attached to intensify the workout.

Another object of my invention is the canvas-like harness. The canvas-like material used for the harness provides a durable stronghold when using the current invention. Another object of the invention is the sturdy frame which enables the ball to move freely without elastic band interference; therefore simulating the act of throwing precisely.

DETAIL DESCRIPTION

Figure 1:
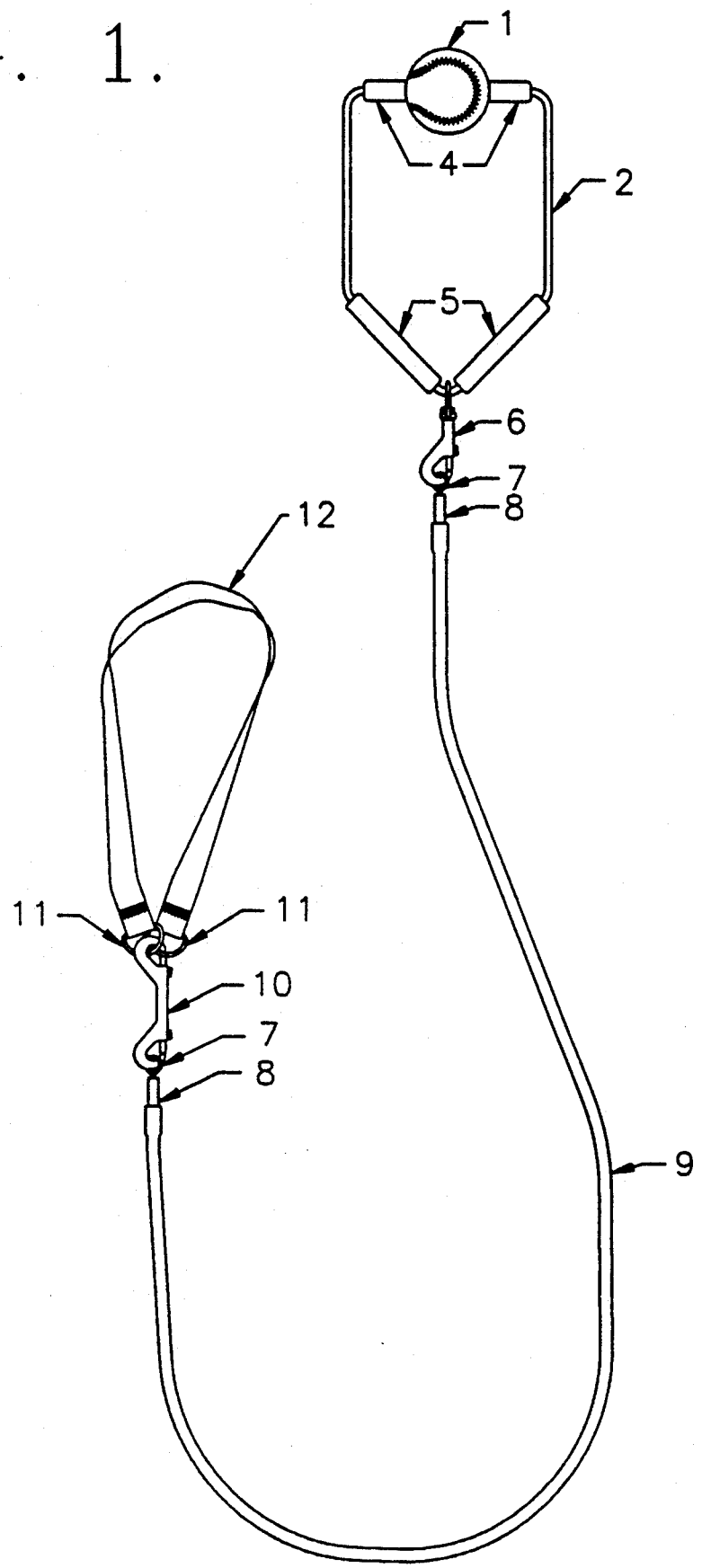
FIG. 1 is an isometric view of the baseball throwing device embodying my invention.
Figure 3:
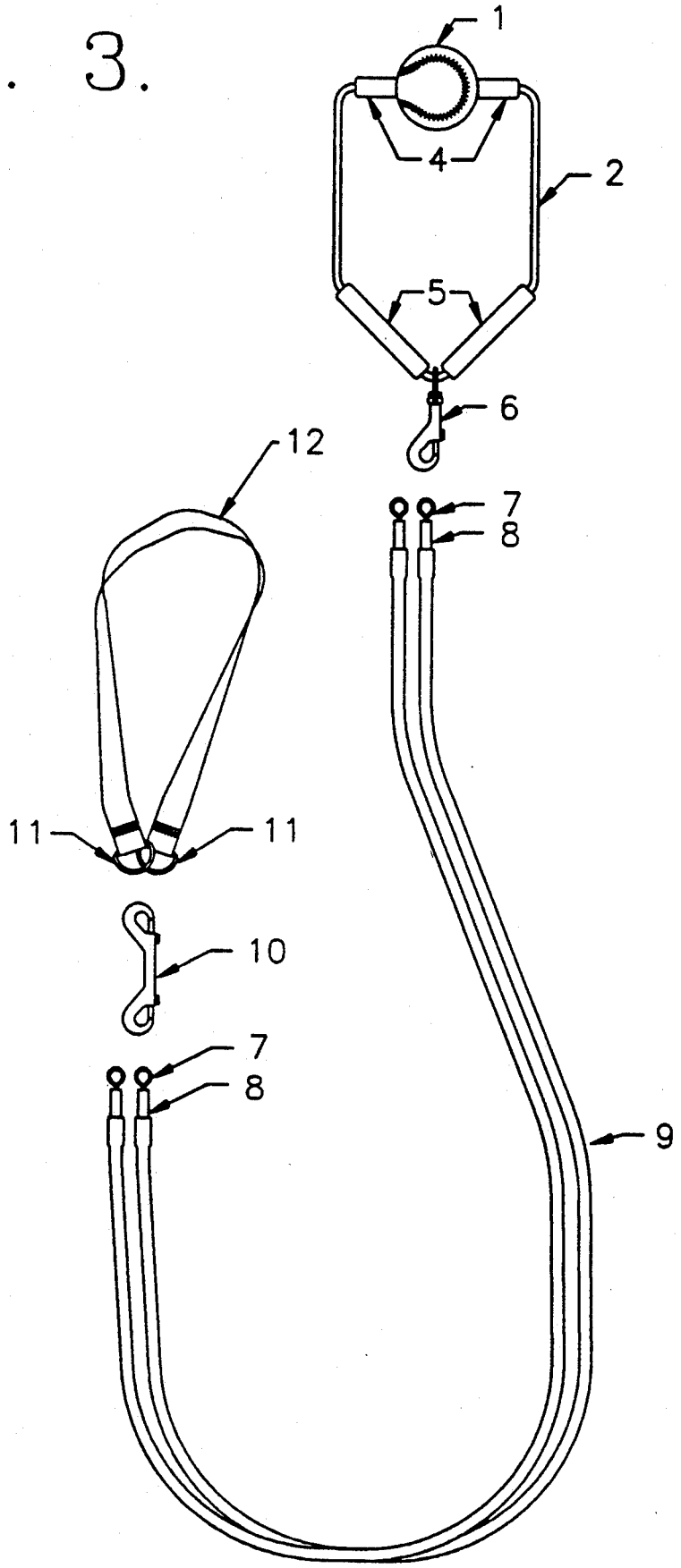
FIG. 3 is an isometric view showing various components embodying my invention.

FIG. 1 and 3 illustrate an isometric view of the Baseball Throwing Device that can be used to develop or rehabilitate the muscles associated with throwing.

The present invention comprises of an official or simulated baseball 1, ¼" steel or plastic frame 2, padding 4,5, swivel hook 6 which hooks to an eye screw 7. The eye screw 7 has been inserted into a ⅜" W×2" L plastic rod 8. The combination of the eye screw 7 and plastic rod 8 is inserted partially into ⅜" W elastic tubing 9. The elastic tubing 9 is 5' L. Double snaphook 10 hooks to the eye screw 7 at one end and to the harness rings 11 at the other. The harness is comprised of a canvas-like strap 12 and steel rings 11. The strap 12 is looped through the rings 11 and sown so that the rings 11 are secured.

Figure 2:
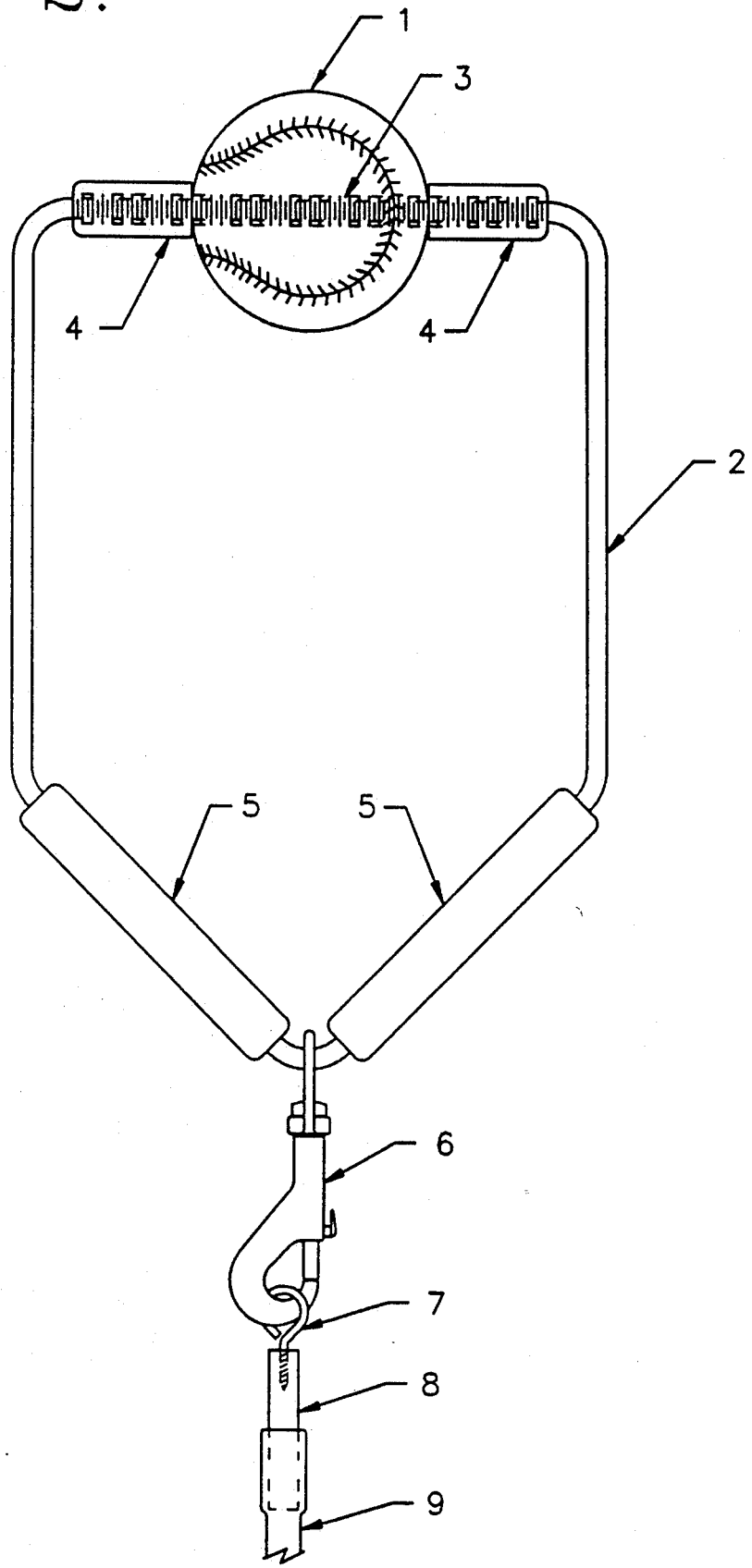
FIG. 2 is an enlarged sectional view of the hand frame and attachments.

FIG. 2 illustrates an enlarged sectional view of the hand frame and attachments. The hand frame is made of ¼" W steel or plastic rod 2 in the shape of home plate. The baseball 1 has a ½" W×6" L threaded pipe secured through the middle, allowing for the baseball to spin freely on the steel frame 2. The padding 4,5 is for comfort. The swivel hook 6 allows for attachment to the eye screw 7. The eye screw 7 is inserted into the plastic rod 8 and the plastic rod 8 is inserted approximately 1 inch into the elastic tubing 9.

FIG. 3 shows the various components of the invention. The baseball 1 is where the user would place his/her hand to simulate pitching or to exercise. Relative to the invention being used for softball, a softball may replace the baseball. The eye screw 7, plastic rod 8, elastic tubing 9 combination can be referred to as an elastic band 7,8,9. The user has the option of using additional elastic bands 7,8,9 for greater tension. Another advantage of having the elastic bands as separate components is that the bands can be replaced if damaged. The elastic bands 7,8,9 will be available for purchase as separate components. The harness 11,12 made of a canvas-like material can be anchored around trees, posts, or other immobile objects that the strap may fit around.

I claim:

1. A baseball throwing practice device which may be used to develop or rehabilitate the muscles associated with throwing, said practice device comprising:

a harness means adapted for securing said device to a stationary object;

an elastic cord resistance means having a first end securable to said harness means and a second end, said first and second ends including attachment means; and an operating means consisting essentially of: a baseball or softball having a hollow tubular rod nonrotatably positioned through a center axis thereof, a rigid frame member formed in a substantially closed loop configuration, being large enough to pass a user hand therethrough, said frame member having at least one linear section which is positioned through said hollow rod, so as to allow said rod, along with said ball to rotate freely on said frame during use, said operating means being attached to said second end of said elastic cord means at a position which is substantially opposite said linear section of said rigid frame member while said ball means is grasped by a user and pulled against said resistance.

2. A device of claim 1, wherein said rigid frame is comprised of metal.

3. The device of claim 1, wherein said rigid frame is comprised of plastic.

4. The device of claim 1, wherein said elastic cord resistance means is comprised of elastic tubing.

5. The device of claim 4 wherein said attachment means is comprises of nylon or plastic rods, having a length of approximately two inches, inserted one inch within said tubing at both ends.

6. The device of claim 5 wherein said attachment mean is further comprised of eye hooks adapted to be insertable within said plastic rods.

* * * * *